United States Patent [19]

Scheuchzer et al.

[11] 4,428,296

[45] Jan. 31, 1984

[54] RAILROAD TRACK RELAYING TRAIN

[75] Inventors: Fredy Scheuchzer, Lausanne; Fritz Buhler, Ecublens, both of Switzerland

[73] Assignee: Les Fils d'Auguste Scheuchzer S.A., Lausanne, Switzerland

[21] Appl. No.: 289,902

[22] Filed: Aug. 4, 1981

Related U.S. Application Data

[63] Continuation-in-part of Ser. No. 30,818, Apr. 17, 1979, Pat. No. 4,307,667.

[30] Foreign Application Priority Data

Apr. 19, 1978 [CH] Switzerland ..... 4178/78

[51] Int. Cl.[3] ..... E01B 27/11; E01B 29/05

[52] U.S. Cl. ..... 104/2; 105/4 R

[58] Field of Search ..... 104/2, 6, 8; 105/4 R, 105/4 A; 213/220

[56] References Cited

U.S. PATENT DOCUMENTS

| | | | |
|---|---|---|---|
| 2,036,535 | 4/1936 | Nelson | 105/4 R |
| 3,165,073 | 1/1965 | Bux et al. | 104/2 X |
| 3,399,631 | 9/1968 | Weber | 105/4 R |
| 3,482,527 | 12/1969 | Helgemeir | 104/8 |
| 3,699,894 | 10/1972 | Plasser et al. | 104/2 |
| 4,000,699 | 1/1977 | Scheuchzer et al. | 104/2 |
| 4,004,524 | 1/1977 | Scheuchzer et al. | 104/2 |
| 4,160,418 | 7/1979 | Theurer | 104/2 |
| 4,207,820 | 6/1980 | Cicin-Sain | 104/2 |

FOREIGN PATENT DOCUMENTS

| | | | |
|---|---|---|---|
| 298055 | 11/1965 | Netherlands | 213/220 |

*Primary Examiner*—Randolph Reese

*Attorney, Agent, or Firm*—Robert E. Burns; Emmanuel J. Lobato; Bruce L. Adams

[57] ABSTRACT

A railroad track relaying train has, in addition to the cars for transporting the ballast screening machines and a car equipped with power-wrenches for fixing the tie-screws, a sequence of working cars including a tie- and rail-removing car, a ballast clearing car, and a tie and rail laying car. These cars have bogie trucks at both ends and are interconnected by means of coupling frames adapted to bear the adjacent ends of the working cars in the trackless working area and supported by caterpillar trucks adapted to keep the working cars on the selected path, when moving on the ballast cleared track bed. Each caterpillar truck is provided with hydraulic cylinders for raising and lowering the coupling frame relative to the respective truck and with mechanisms for driving and steering the truck.

8 Claims, 18 Drawing Figures

RAILROAD TRACK RELAYING TRAIN

REFERENCE TO PRIOR APPLICATION

This application is a continuation-in-part of application Ser. No. 030,818 filed Apr. 17, 1979, now U.S. Pat. No. 4,307,667.

FIELD OF THE INVENTION

This invention relates to a railroad track relaying train which, in addition to cars for transporting rails, ties and their fastening means, comprises at least one sequence of working cars including a track removing car, a ballast-clearing car, a track-relaying car, a tie-screw fixing car and means for transporting the old ballast to a screener installed on a car outside the track-laying area, together with means for transporting the screened ballast to a storage and dispensing bin, preliminary to its distribution on the new track, and other means for transporting the old ties or track panels or spans and the new ties.

Conventionally, a railroad track relaying procedure comprises not only the substitution of new rails and ties for the old ones but also the reclaiming of the ballast, since the old ballast, soiled with dirt and refuse, is clogged and has lost the necessary elasticity and perviousness. On the other hand, the successive additions of gravel during the tie truing and ballast tamping operations are attended by an increment in the track height, and this may prove rather detrimental on railroad sections passing under fixed structures and constructions.

THE PRIOR ART

Nowadays, the ballast is normally cleared and screened before or after laying the new track. Therefore, the time necessary for this specific operation adds itself to the time required for performing the other track relaying operations. On the other hand, this ballast clearing and screening operation cannot be accomplished without resorting to powerful means for lifting the complete track, and this step is obviously attended by the risk of altering the shape of the new rails. Now since ballast clearing and screening machines have extremely large dimensions, putting these machine into operation involves time-robbing and complicated maneuvers both when starting and stopping their operation.

The Applicants are also the owner of the U.S. Pat. No. 4,004,524 disclosing a method for the complete relaying of a railroad track, wherein the operations consisting in removing the old track, clearing and screening the ballast and laying the new track are accomplished during a single passage of the complete track relaying train provided for this purpose. The same patent also describes a train for the complete relaying of a railroad track, which comprises cars for transporting the rails, ties and their fixation means, as well as a sequence of working cars provided with gantries for removing and laying railroad tracks, and two frame-cars, as described in Swiss Pat. Nos. 549,692 and 585,814 also owned by the Applicants. The equipment of this known track relaying train comprise inter alia means for clearing the ballast and transporting same to a screener mounted on a car located outside the track relaying area. The frame-cars are interconnected by an intermediate bogie-truck supported by a caterpillar chassis and provided with retractable wheels for normal passages of the train. The frame-cars have no own undercarriages at their ends adjacent to said intermediate bogie-truck, so that the two frame-cars and the intermediate bogie-truck form an assembled two-link unit that cannot be separated.

In order to limit traffic hindrance during the track relaying operations it is in general prescribed that on double-track railroads the adjacent parallel track or siding must not be blocked. By this requirement the maximum width and the maximum length of the working cars are limited in such a way that even in short radius curves their clearance gauge or passage section must always have a sufficient distance from the passage section of the adjacent parallel track.

SUMMARY OF THE INVENTION

It is the essential purpose of this invention to provide an improved railroad track relaying train whereby all the operations consisting in removing the old ties and rails, and the excavation of the worn ballast, as well as the laying of new ties and new rails, are accomplished without stopping the machine and simultaneously with the removal of the old ties and rails, and in such a way that the train will still better fit within the maximal permissible moving dimensions or passage section while increasing the width of the working cars and reducing their wheelbase.

These improvements together with other advantageous features to be described presently are obtained by providing working cars having bogie trucks at both ends and by interconnecting the working cars by means of coupling frames that carry the adjacent ends of said working cars and are supported by special trucks adapted to travel on the ballast and/or on the cleared track platform or sub-grade, or on the screened ballast, and adapted to be lowered more or less in relation to the relevant coupling frames, so as to raise adjacent ends of said working cars with their bogie-trucks in the trackless working area, and finally by the fact that each coupling frame interconnects two adjacent cars through the medium of universal joints and guide members for the purpose of maintaining the position of the working car concerned in relation to the coupling frame.

This arrangement has the main advantage that two working cars equipped with usual on-track undercarriages at both ends, together with their intermediate coupling frame form a three-link group of vehicles which can better approximate a curve in a trackless working area than two directly coupled working cars.

Moreover the working cars have a larger width and a reduced wheel base.

THE DRAWINGS

DESCRIPTION OF THE PREFERRED EMBODIMENTS

The railroad track relaying train according to this invention may be constructed for carrying out two different methods of removing the old ties and the old rails:

1. A method for removing and loading only the old ties (FIGS. 6, 8, 9 and 13). The old rails 1 are spread apart and laid behind the machine either on the shoulder of the bedding or along the track axis. They are discharged at the end of the relaying operations.

Figure 10:
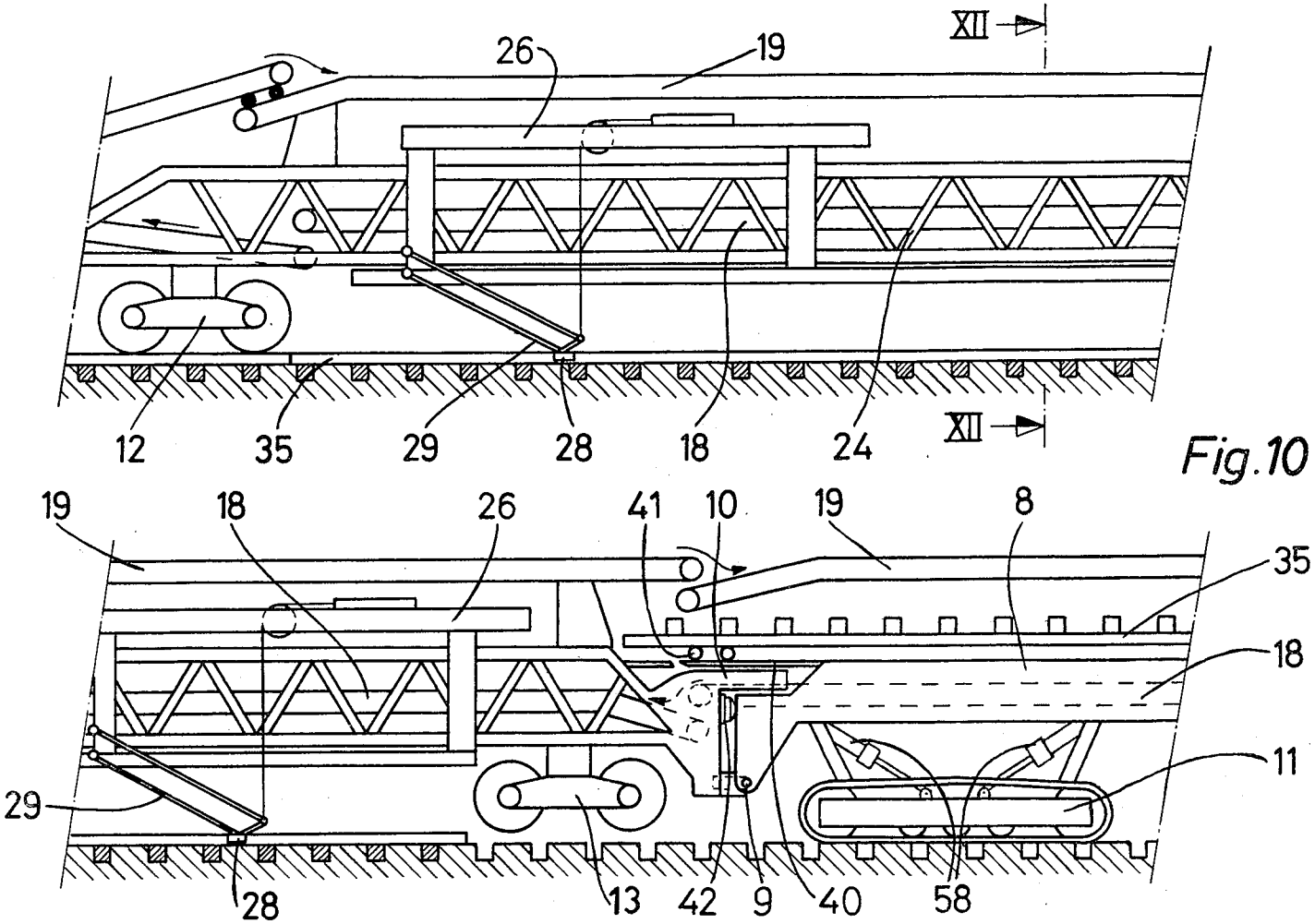
FIG. 10 is another fragmentary side-elevational view showing a modified form of embodiment of the track removing car for removing complete track panels.
Figure 12:
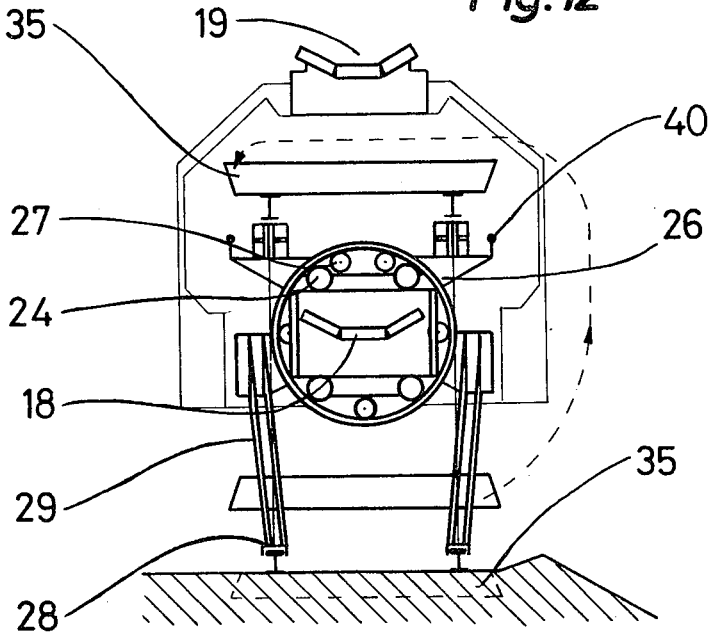
FIG. 12 illustrates in cross-section along line XII of FIG. 10 the movement of the track panel.
Figure 15:
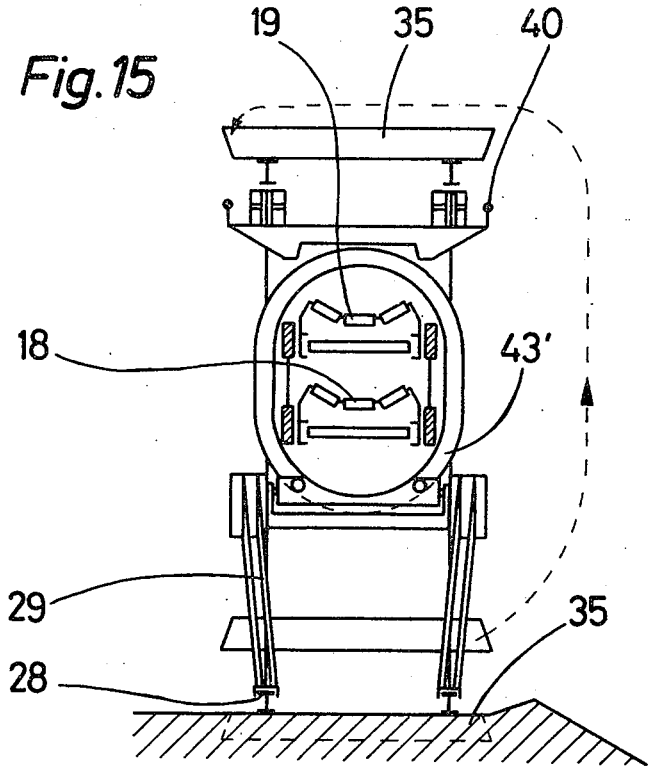
FIG. 15 illustrates an embodiment similar to that of FIG. 13 but for track panels.

2. A method for removing complete track panels or spans with the assistance of a rotary elevator 26 adapted to lift and turn the track panels upside down and to lay them upon lorries 41 rolling on a transport runway or level 40 so as to be eventually discharged by means of gantries (FIGS. 10, 12 and 15).

The railroad track relaying train comprises six main component elements shown diagrammatically in FIGS. 1, 2, 14 and 16, namely a screener car 4 (shown only in FIG. 16), a track removing car 5, a ballast-clearing or excavating car 6, a track-relaying car 7, and (shown in FIG. 14) a tie-screw fitting car 46 followed by transporting cars 47, and gantries 48 and 49 connected by girder 50 equipped with a transport beam (not shown).

The car 4 with the ballast screening machine and the tie-screw fitting car 46 are conventional two-bogie-truck cars. The track removing car 5, the ballast-clearing car 6 and the track-relaying car 7 constitute together a hinged sequence of wagons supported by six bogie-trucks 12 to 17 and interconnected by coupling frames 8 and 8' each of which is equipped with a caterpillar or track-laying truck 11 and 11' respectively. Although various conveyors cross over coupling frames 8 and 8' (FIGS. 6 and 10), no track working tools or equipment are mounted on these frames.

Figure 5:
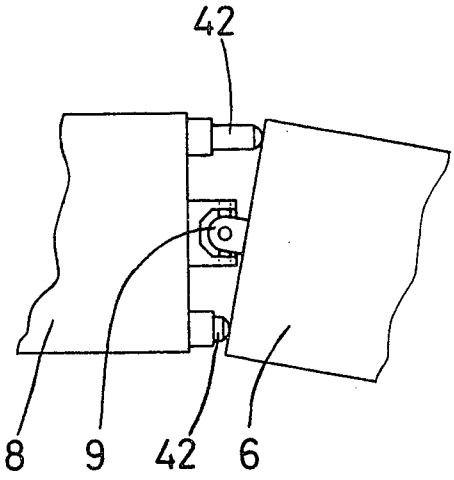
FIG. 5 is fragmentary view of the coupling between a working car and a coupling frame showing the hydraulic bumpers whose length can be controlled individually.

During the track relaying operations, the screener 4 and the first bogie-truck 12 of the track removing car 5 run on the former track 1. The central section of the train bears on the caterpillar or track-laying trucks 11 and 11' rolling the leading one on the ballast and the trailing one on the excavated track platform, or on the screened ballast. The rear-bogie-truck 17 of the track relaying car 7 as well as the tie-screw fitting car 46 run on the new track 1'. Each coupling frame 8, 8' interconnects two adjacent working cars by means of universal or Cardan joints 9. Guide members 10 provided at one end of each working car are resting on the adjacent end of the respective coupling frame (FIGS. 2, 3, 6, 10) for keeping the chassis of the car concerned in the proper transverse parallel position in relation to the coupling frame 8. The other end of each working car can freely incline with respect to the adjacent coupling frame when the train passes through a banked curve. Controlled hydraulic bumpers 42 are also provided for guiding the relevant coupling frame 8, 8' in a predetermined longitudinal position with respect to the car chassis or, if the train is moving in a curve, in a predetermined angle with respect to said car chassis, as shown in FIG. 5.

Figure 7:
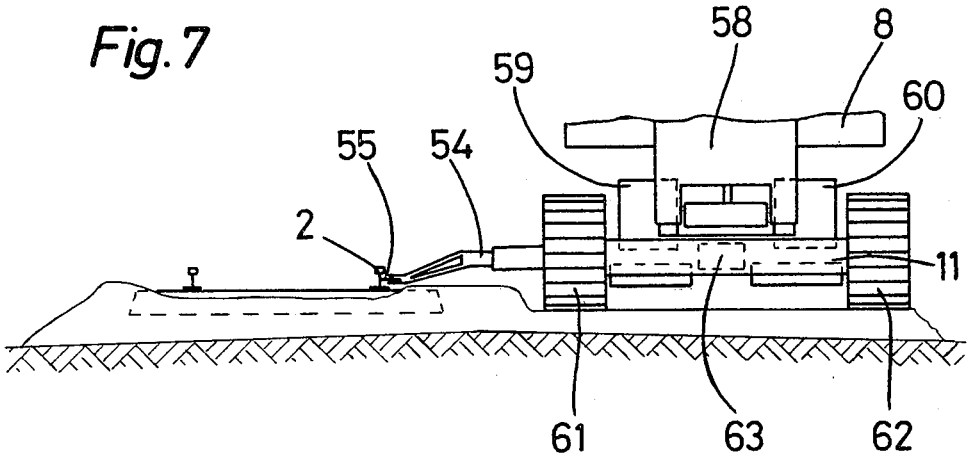
FIG. 7 is a view of the coupling frame in the direction of arrows VII of FIG. 6 showing the feelers palpating the adjacent parallel truck.
Figure 6:
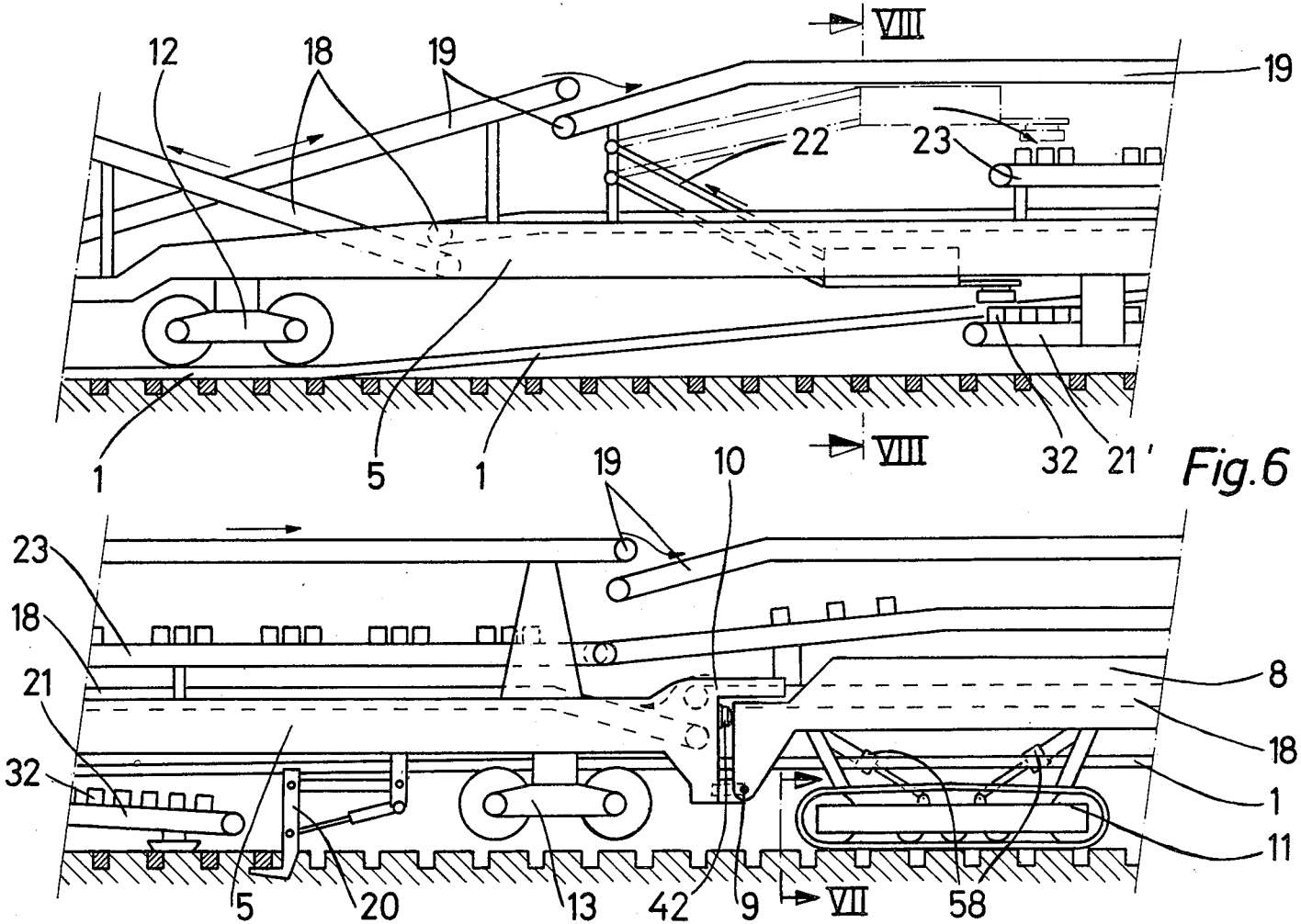
FIG. 6 is a fragmentary side elevational view of a track removing car with its tipping elevator.

FIGS. 6 and 7 illustrate schematically the arrangement of the caterpillar truck 11 and its coupling frame 8. The other caterpillar truck 11' and its coupling frame 8' are built up in the same way.

According to FIGS. 6 and 7 the caterpillar truck 11 has a pair of track members 61, 62 (FIG. 7) and is equipped with lifting means 58 comprising hydraulic cylinders for lowering and lifting the truck in relation to its coupling frame 8. Each of the caterpillar track members 61 and 62 at both sides of the caterpillar truck 11 is driven individually by adequate hydrostatic drive means 59 and 60 that provide an infinitely variable working speed and allow the guiding and steering of the caterpillar truck 11 along a curve in a conventional manner by driving one caterpillar track member 61, 62 at one side with a lower or a higher speed than the other one at the other side.

Automatic control or servo means 63 (FIG. 7) are provided which control during the operations the drive and steering means, that is the hydrostatic drive means 59 and 60, so that the caterpillar truck 11 follows the trace of the former track 1 or a trace parallel thereto when it is desired to change the distance between parallel tracks.

For this reason the automatic control or servo means 63 may be controlled in different ways to guide and steer the caterpillar trucks.

Figure 1:
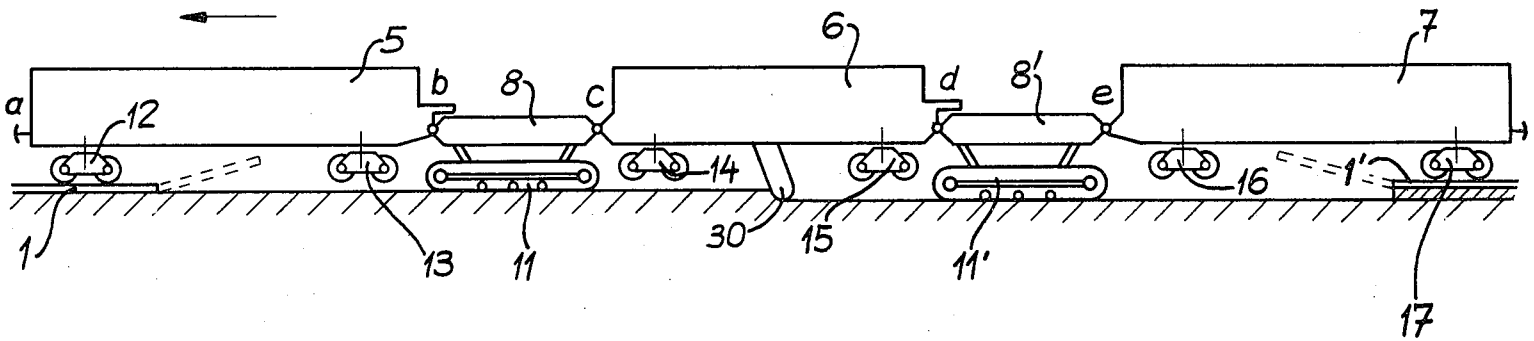
FIGS. 1 and 2 illustrate diagrammatically the general arrangement of a railroad track relaying train according to this invention.
Figure 2:
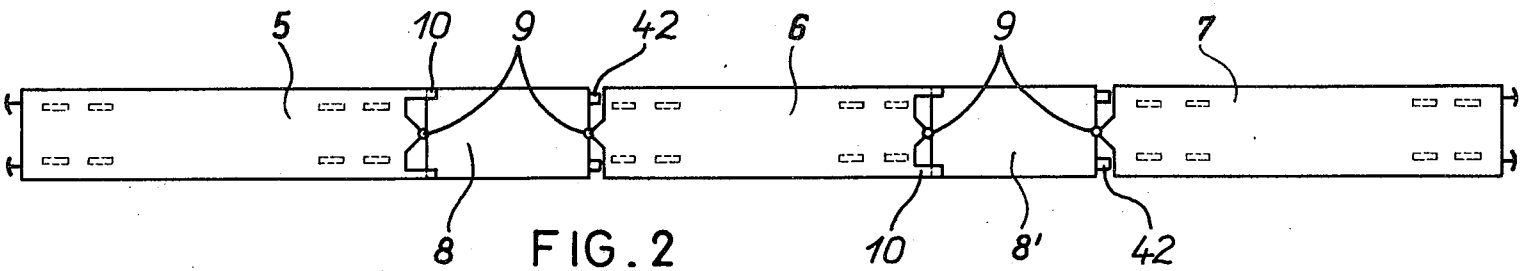
Figure 3:
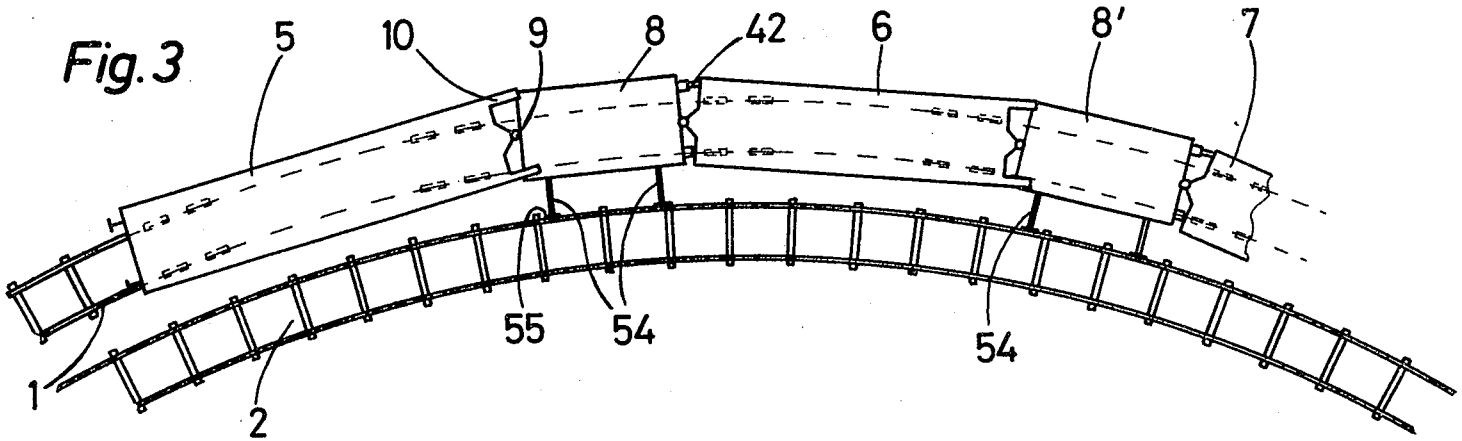
FIGS. 3 and 4 illustrate the train in a curve, provided with feelers palpating the parallel adjacent track respectively a span wire as a reference for guiding the caterpillar trucks.
Figure 4:
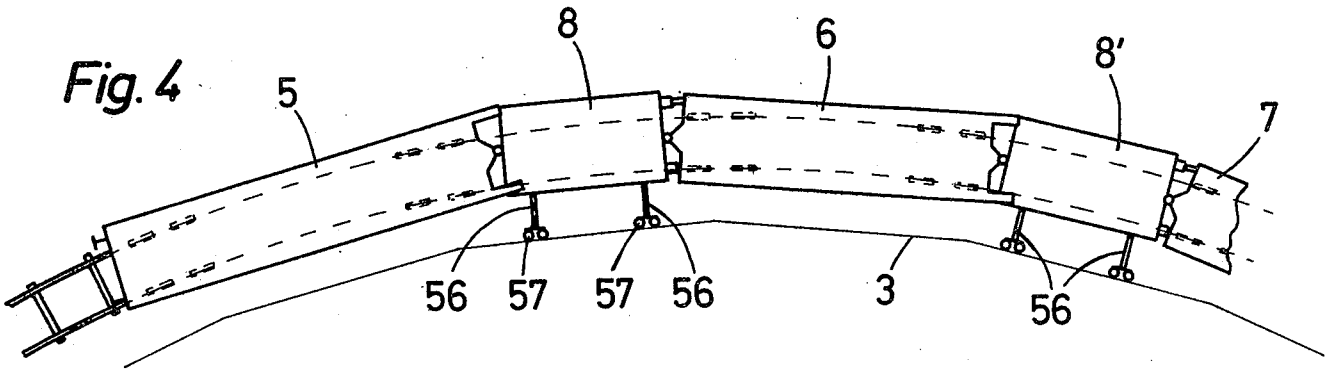

This control can be accomplished by using the parallel adjacent track 2 (FIGS. 3 and 7) or a span wire 3 (FIG. 4) as a reference base, this wire 3 being tensioned along a polygonal line approching the trace of the track. Feeler devices 54 with extensible or telescoping rail feelers 55 (FIGS. 3 and 7) or feeler devices 56 with extensible or telescoping feeler rollers 57 (FIG. 4) mounted on the caterpillar trucks 11, 11' sense the parallel track 2 or the span wire 3, respectively, and measure continously the distance between said reference base and the caterpillar trucks, this distance being a measure for the desired run of these trucks, and a corresponding control signal is transmitted to the servo means 63 for steering the caterpillar trucks. The same measuring and controlling principle known per se may be used for adjusting the tie-laying machine on the working car 7.

For assisting the guiding of the coupling frames and for maintaining them in a predetermined position with respect to the adjacent working car it is preferable to have the already mentioned hydraulic bumpers 42 whose length can be individually controlled. In this way the distances on both sides between a coupling frame and the adjacent working car can be defined by the respective controlled lengths of the two bumpers 42 as shown in FIG. 5 for the coupling frame 8 and the working car 6 when passing a curve.

Figure 16:
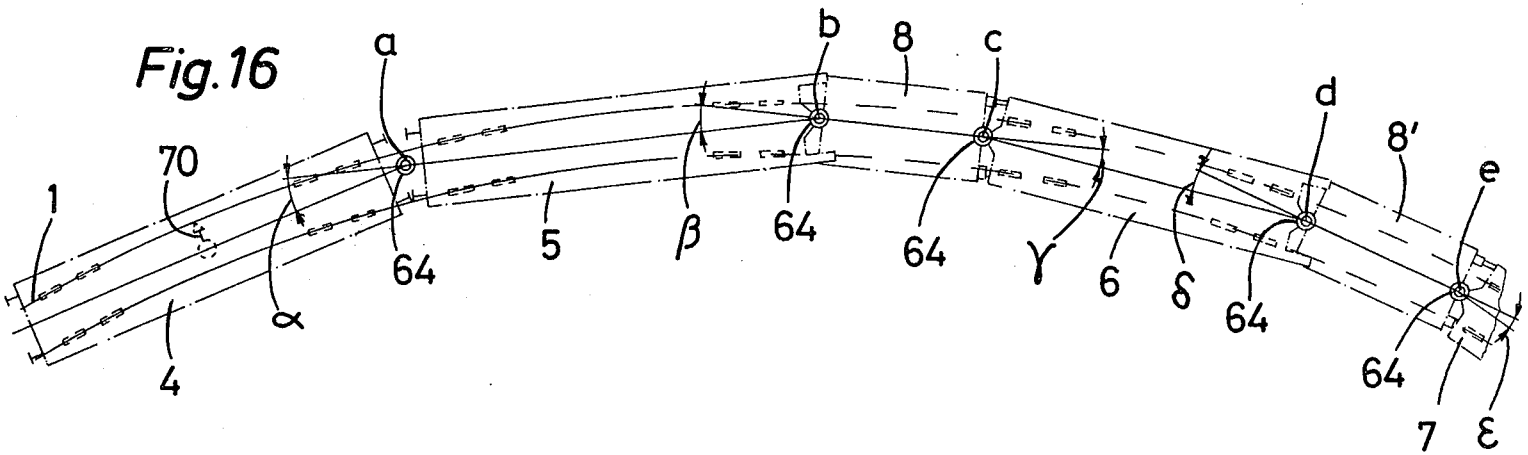
FIG. 16 illustrates schematically the geometrical inscription of the train in a curve, provided with angle-measuring devices for measuring respectively controlling the angles between adjacent cars and between a working car and the adjacent coupling frame respectively.

FIG. 16 illustrates another way for controlling the servo means 63 (and also the tie-laying machine) by using an angle reference and measuring system for determining the trace of the caterpillar trucks. This system comprises at least the angles $\alpha$,$\beta$, $\gamma$, $\delta$ and $\epsilon$ between the longitudinal axes of successive adjacent cars and of working cars and adjacent coupling frames, respectively, beginning with the angle $\alpha$ between the screener car 4 that is still wheeling completely on the former track 1 and the track removing car 5. These angles may be measured by known electrical angle-measuring instruments in the form of a rotary potentiometer 64 mounted at or near the linking or coupling point a, b, c, d and e between adjacent cars 4, 5 and between a car and the adjacent coupling frame 5,8; 8,6; 6,8' and 8',7, respectively.

The measured angle $\alpha$ indicates always the curvature of the former track 1 near the beginning of the working area and represents therefore a reference value signal that is transmitted to the servo means 63 and from which the corresponding steering signals for the steering means are obtained or derived. The measured angles $\beta$, $\gamma$, $\delta$ and $\epsilon$ indicate the actual values of the path followed by the caterpillar trucks, and the steering operations are carried out so that these actual angles approach as exact as possible to the reference angles derived from the measured angle $\alpha$. Since the curvature of a track curve is in general constant, all angles must be maintained equal and constant once the train has entered the curve.

Naturally it is also possible to use other known angle-measuring devices e.g. known optical angle-measuring instruments. Moreover it may be useful to include further reference angles to be measured between other adjacent cars of the train wheeling ahead of the working area and/or behind the working area on the new track 1', as between the track relaying car 7 and the tie fixing car 46 (FIG. 14), so that the curved path to be followed by the caterpillar trucks could be derived more exactly if necessary.

It will be obvious to those skilled in the art that in principle every known measuring and reference system, which is used for railroad track-laying or track-maintenance machines as track levelling, aligning and tamping machines (e.g. U.S. Pat. No. 3,314,154, G.B. Pat. No. 1,479,230) can also be applied to obtain the adequate control signals for the servo means 63 to control the steering means of the caterpillar trucks. By applying these known methods and measurement and control devices to the steering according to the present invention, devices responsive to the position of the former track 1 may be used, whereby this track 1 is measured by rail feelers mounted on the screener car 4 ahead of the working area.

The sensing points of these rail feelers serve to derive or calculate the curvature of the former track 1 corresponding to the curved trace to be followed by the caterpillar trucks 8 and 8'. In FIG. 16 such a rail feeler 70 is schematically shown in dotted lines.

Finally the steering of the caterpillar trucks may also be accomplished by using manual control means whereby an operator controls the steering means according to reference marks fixed along the track; such marks are commonly used for track laying or correcting operations.

The coupling frame 8 or 8' as described serves only to connect two working cars by a hinge member and to support and move them in the trackless working area, without carrying any working machine or working head. In this way two working cars and their coupling frame representing a sort of intermediate chain link form a three-link group of vehicles instead of a two-link group that would result if the two working cars would be coupled directly. This has the principal advantage, that in a curve the length of overhang of the working cars can be reduced and that even cars being rather large in width remain in the prescribed passage section if they run through a curve.

Another advantage consists in a very simple construction of the coupling frame 8, 8' which does not have to carry any working machines or working heads and which does not need any on-track undercarriages. A further advantage is the fact that the working cars are equipped with usual on-track undercarriages or bogie trucks 12,13; 14,15; 16,17 at both ends; therefore outside the trackless working area they can run on the rails like a normal car and independently of any coupling frame.

The track removing car 5 (FIGS. 1 and 6) is supported at the front by the bogie-truck 12 and at the rear through the intermediary of the hinged coupling frame 8 supported in turn by the relevant caterpillar truck 11. Mounted on the car 5 are the conveyors 18 for the excavated material and the overhead conveyors 19 for the reclaimed ballast. The old ties 32 are removed and transported by using a hydraulic excavator or digger 20, endless-chain conveyors 21 and an elevator 22.

Behind the bogie-truck 12, roller-type rail-jacks (not shown) are provided for lifting and spreading apart old rails 1 which are subsequently transferred along the machine and eventually laid at the rear upon the track sub-grade or platform or along the track axis.

Figure 8:
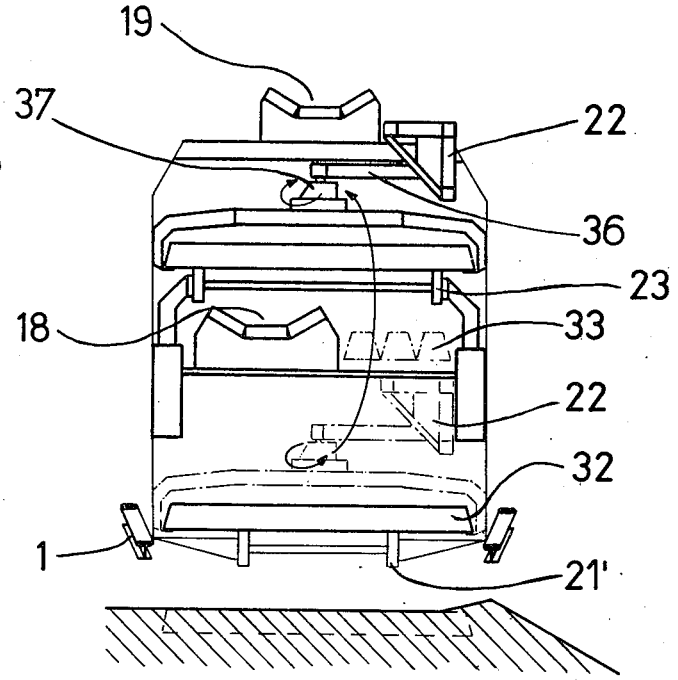
FIGS. 8 and 9 are a cross section of this car along line VIII of FIG. 6 and a plan view from above showing the path of the tie movement, respectively.
Figure 9:
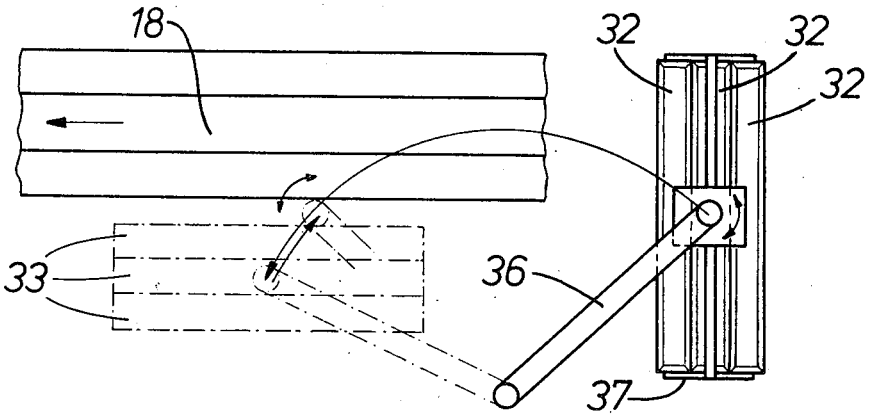

In the exemplary form of embodiment illustrated in FIGS. 6, 8 and 9, the hydraulic excavator or digger 20 extracts the old ties 32 one by one from the ballast and lays them down upon an endless chain conveyor 21 directing the old ties onto a storage conveyor 21'. The elevator 22 comprises a pivoting arm 36 and a rotary clamping head 37 and is adapted to pick up three ties 32 at a time from the storage conveyor 21', lift and pivot these ties backwards by means of the pivoting arm 36, thus causing them to rotate through 90 degrees in the track plane with the rotary clamping head 37 (FIG. 9). Then the elevator 22 lifts the turned ties 33 laterally of the old-ballast conveyor 18, above the level of the tie conveyor 23 (FIG. 8). The ties are subsequently pivoted and rotated forwards still in the plane of the underlaying track and finally laid upon the conveyor 23 which transfers them to the transport gantries. The elevator is then returned through the same path to its initial position.

All the movements of the working cycle may be controlled automatically or manually.

Alternatively, the track removing car 5 may be equipped with an elevator 22 arranged for lifting and pivoting the ties in the track plane around both conveyors 18 for the old ballast and 19 for the screened ballast, respectively.

Figure 13:
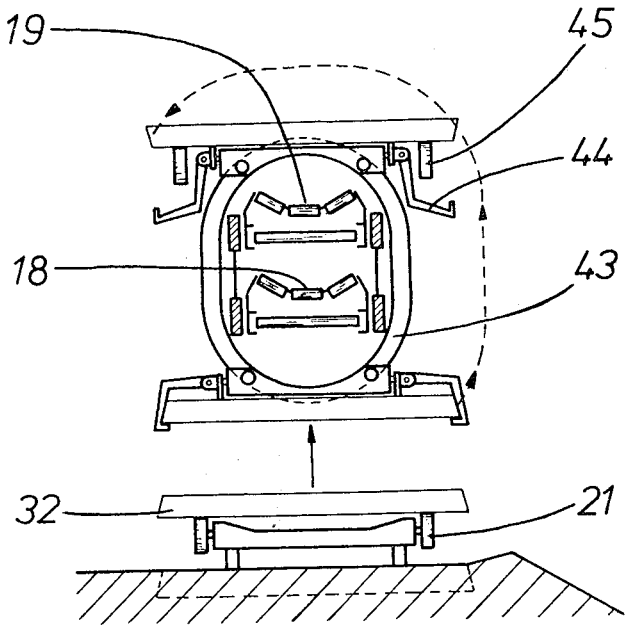
FIG. 13 is a cross section showing a modified form of embodiment of the track removing car with its rotary elevator for ties.
Figure 14:
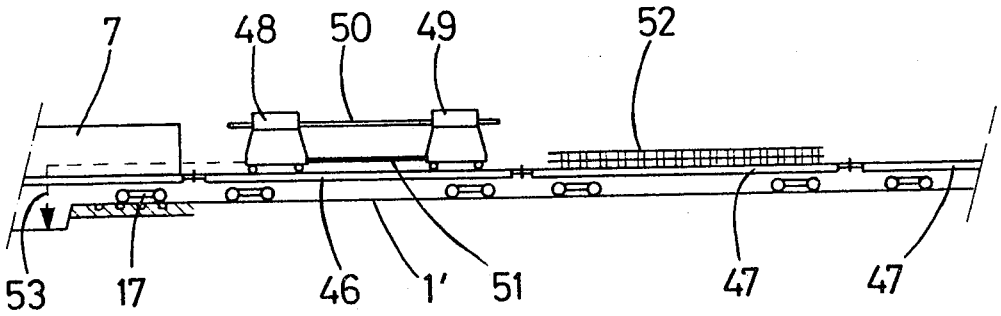
FIG. 14 is a schematic side elevation illustrating the general arrangement of the track relaying train with the tie-screw fitting car and transporting cars.

In another form of embodiment of the invention illustrated in FIG. 13, the rotary elevator 43 provided with hydraulic claws 44 mounted on a lifting system is adapted to grip three ties at a time from the storage conveyor and to lift them against the elevator. The latter turns the ties around the old ballast conveyor 18 and screened ballast conveyor 19, and eventually deposits the ties upside down upon the top level from which they are picked up by the movable conveyor 45 and transferred to the gantries. Then, the elevator 43 resumes its initial position. All the movements of the cycle are controlled automatically or manually.

Alternatively, the tie removing car 5 may be provided with an elevator 43 adapted to turn the ties only around the old ballast conveyor 18 as in the case illustrated in FIG. 8, but in this modified version the ties are disposed upside down on the conveyor 45.

In another specific form of embodiment for removing complete track panels or spans 34, as illustrated in FIGS. 10 and 12, the track removing car 5 comprises a central girder 24 in which the conveyor 18 for the excavated material is housed, the conveyor 19 for the reclaimed ballast being located overhead. A rotary elevator 26 equipped with hoisting means and a runway 40 for the lorries 41 is suspended by means of rollers 27 from the central girder 24. The hoisting means comprises two pairs of rolling claws 28 secured to hinged frames 29, with hydraulic cylinders for lifting and moving said claws laterally. The track panels are disposed upside down on the lorries 41 rolling on runway 40.

In a modified version of this embodiment according to FIG. 15, the track removing car 5 may be equipped with a rotary elevator 43' similar to FIG. 13, adapted to lift and rotate the track panels 34 by means of rolling claws 28 secured to hinged frames 29 (as in FIG. 12) both around the old ballast conveyor 18 and around the screened ballast conveyor 19, so that the track panels are disposed upside down on lorries rolling on runway 40' above conveyor 19.

The track panels may be removed without discontinuing the operation of the machine. During the picking up of the next track panel, the one stored on the ballast-clearing machine is moved forwards by another train of lorries until it reaches the relaying car 7 where it is taken over by the gantries 48, 48 (FIG. 14) and transported on loading wagons.

The ballast clearing car or machine 6 (FIG. 1) comprises a pair of bogie-trucks 14, 15, an excavator 30, a ballast metering unit and means for transporting the ballast, the track ties or the track spans or panels. This car 6 is coupled at its leading end to the track removing car 5 and at its trailing end to the track-relaying car 7, both couplings occuring through the hinged connecting frame 8, 8' supported by the caterpillar truck 11, 11'. During the track relaying operations, the track clearing machine is supported by the pair of caterpillar trucks 11 and 11' running on the old ballast and the excavated track platform, or on the screened ballast.

Figure 11:
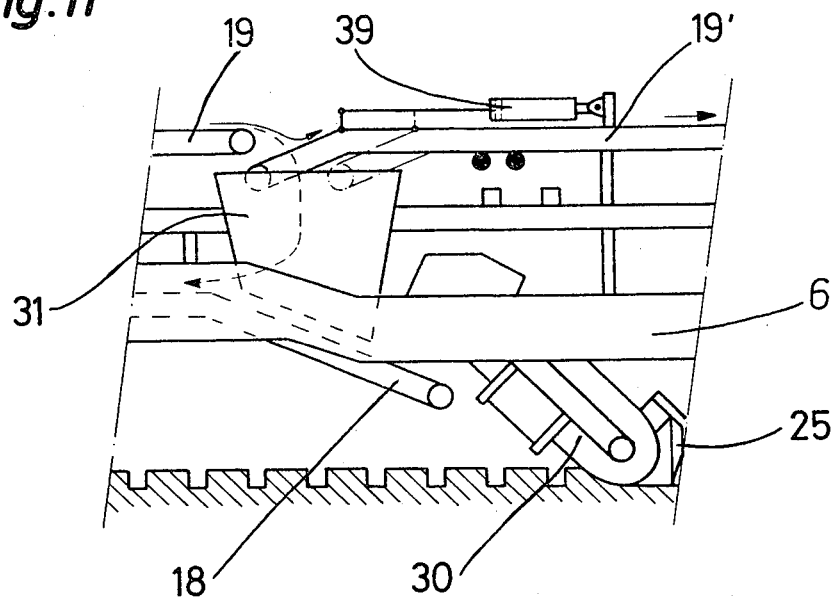
FIG. 11 is a detail view showing the adjustable connection between the means transporting the screened ballast and the used or old ballast.

The excavator 30 comprises an excavating chain and an equalizing or levelling blade 25 FIG. 11. The excavator is pivotally mounted on the frame and suspended by means of hydraulic cylinders so that the working depth and inclination of the platform can be adjusted at will. The blade is provided with side plates adjustable during the operation of the machine by means of hydraulic cylinders. Behind the levelling blade 25 a tamper is provided for compacting the track platform.

The material dug by the excavator is delivered by the excavating chains to conveyors 18 and thus directed towards the screener. The reclaimed and screened ballast is then directed by conveyors 19 to the rear end of the train and fed to the reclaimed-ballast metering device comprising a fixed bin and a metering element adjustable in the vertical direction as a function of the requisite thickness of the ballast layer. From the storage bin, the ballast is fed to the metering device to provide the first ballast layer and the excess ballast is delivered to an intermediate conveyor and thus fed to the ballast distributor mounted on the track relaying car. Behind the ballast metering device a tamper is also provided for compacting the ballast before laying the ties.

The relatively long transport path followed by the old ballast and by the screened ballast along the train may become an inconvenience when the train is stopped for any reason during its operation. It would be necessary to stop all the conveyors carrying excavated and screened material for preventing an unequal distribution of the ballast beneath the laying car. Now starting all the loaded conveyors simultaneously would constitute a heavy demand of electric power and might delay the resumption of normal operations. To avoid these drawbacks, the present invention provides a transport connection established at will but preferably automatic each time the train is stopped. To this end, a hopper 31 located as close as possible to the excavating chain is disposed between the transport chains 18 for the old ballast and 19 for the screened ballast. The transport connection, creating a closed-circuit condition between the screened ballast and the used ballast, is obtained by shifting the screened ballast conveyor 19' with the assistance of a hydraulic cylinder 39 when the machine is stopped (FIG. 11).

The track relaying car 7 provided with two bogie-trucks 16 and 17 is equipped with tie-laying means, together with the conveyor elements, the rail laying members and the ballast distributor. During operation, the car 7 is caused to bear at its front end on the caterpillar-mounted coupling frame 8' and at its rear end on the bogie-truck 17 rolling on the new track 1'. Also mounted on the rear portion of the car 7 are the new rails laying members comprising, inter alia, roller claws, clamps or nippers.

The new ties 52 stored on transport cars 47 (FIG. 14) are transferred by means of gantries 48, 49 to a storage conveyor 51 of the car 46 equipped with the tie-screw fitting means. An intermediate conveyor separates the ties and feeds them to rotary clamps disposed at the rear end of the track relaying car 7. These clamps lift and turn two ties at a time, and lay them upon a longitudinal conveyor divided into several sections for the intermediate storage. The ties 52 are thus transferred by the longitudinal conveyor to the tie-laying machine where they are centered, positioned and finally laid upon the ballast, as shown schematically by arrow 53 in FIG. 14.

The relative spacing of the ties thus laid down is set by means of a measuring device adapted to change this spacing centimeter by centimeter. The ties are also positioned in the transverse direction either by means of a feeler controlling the distance between the tie axis and the parallel track or by means of a measuring system associated with adequate control means provided on the working car.

The tie-screw fitting car 46 (FIG. 14) comprises power-wrenches for fastening the new rails by means of tie-screws. Moreover, this car 46 is used for transporting the gantries 48 and 49. The dimensions of this car 46 are such that crew can fit the tie fastening means from inside the car.

The pair of self-propelled gantries 48 and 49 is constructed according to the teachings of Swiss Pat. No. 549,692, for transporting the old and new ties to and from the working cars and the transport cars 47. These two gantries 48, 49 are intereconnected by the central girder 50 from which a tie transporting beam (not shown) is suspended by means of ropes and hydraulic cylinders. It also comprises hydraulically actuated claws for gripping the ties or the track panels.

The complete relaying of a railroad track according to the instant invention comprises the following operations:

I—Removing the old ties and rails or the old track panels.

In the first case: Removing the rail fixing means in front of the machine; spreading the old rails apart, behind the front bogie-truck of the rail removing car, with the assistance of rolling claws; extracting the old ties by using the hydraulic excavator and transferring them through the chain conveyors and an elevator to the storage conveyor at the laying car.

In the second case: Removing the old track panels by means of the rotary elevator, then laying them upon the lorries and transporting them in two successive runs to the laying car.

II—Excavating the ballast, equalizng and compacting the track sub-grade or platform;

III—Screening the ballast by using a vibrating screen and a rotary screen; the reclaimed ballast is transported to the metering device behind the excavation chain and to the ballast distributor at the rear end of the track relaying car; any refuse is either deposited laterally of the track platform or loaded into a special car;

IV—Laying the new ties by using the tie laying apparatus;

V—Laying the new rails on the ties by using rotary claws in front of the rear bogie-truck of the track relaying car;

VI—Transporting the old ties or, as the case may be, the old track panels, by using the gantries to the transport cars and supplying new ties by using the gantries from the transport cars to the relaying car.

VII—Fixing the rails by using the tie-screw fastening means contemplated.

Figure 18:
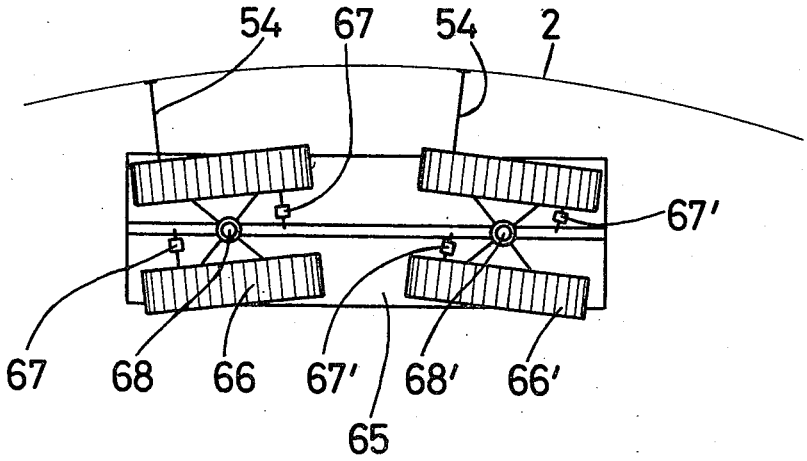
FIG. 18 illustrates schematically such a coupling frame in a curve.
Figure 17:
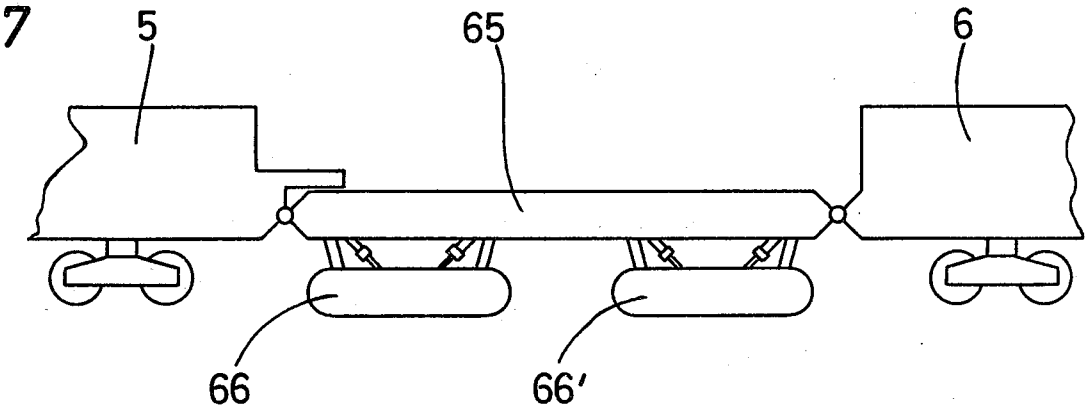
FIG. 17 shows a fragmentary view of another form of embodiment of a train having a coupling frame provided with two caterpillar trucks at both ends.

FIGS. 17 and 18 illustrate another embodiment of a coupling frame connecting two working cars 5 and 6. This coupling frame 65 is supported by two caterpillar trucks 66 and 66' at both ends. Each caterpillar truck has a pair of caterpillar truck members and is mounted on a turntable and rotatable about a vertical axis 68, 68'; it can be steered by hydraulic cylinders 67, 67' that act in a horizontal transversal direction between the understructure of the respective truck and the chassis of the coupling frame 65 and therefore control the rotation of the truck 66, 66' about said axis 68 or 68'. Moreover each caterpillar truck is equipped with feelers 54 for sensing the parallel track 2 as described in connection with FIG. 3. Hydrostatic drive means (not shown) serve to drive the caterpillar trucks, lifting means (not shown) are adapted to raise or to lower the coupling frame 65 in relation to the caterpillar trucks, and servo means may be provided for an automatic steering and guiding as described in connection with FIG. 7.

The provision of two steerable caterpillar trucks 66 and 66' at both ends of a coupling frame 65 improves and facilitates in general the steering operations and steering movements in a curve and allows to trail a given curved path in a more exact manner.

What is claimed is:

1. A train for relaying railroad track in a relaying zone comprising:

(a) cars for transporting ties and fixing means, (b) a sequence of working cars comprising at least a car for removing old rails and ties or track panels, a ballast excavating car, and track relaying car, each of said working cars carrying working instrumentalities and having at both ends bogies adapted to run on rails;

(c) a coupling frame between each two consecutive working cars and connected by universal joints with adjacent ends of said cars, said coupling frames carrying no working instrumentalities, (d) at least one track-laying or caterpillar truck supporting each of said coupling frames and adapted to move on the ballast or cleared track bed, means for raising and lowering said coupling frame relative to the respective track and means for driving and steering said trucks, said ends of said working cars being supported by said coupling frame in its raised position to unload said bogie trucks adjacent to said ends and to carry them in a lifted position above said ballast or cleared track bed, (e) controllable hydraulic bumpers or buffers on opposite ends of said coupling frames for keeping the coupling frames in predetermined longitudinal relation to said working cars between which said coupling frames are disposed, and (f) guide members provided at the end of a working car adjacent a coupling frame and bearing on the adjacent end of the respective coupling frame for keeping the chassis of said car in the proper transverse parallel position in relation to the coupling frame.

2. A rail road track relaying train according to claim 1, in which said steering means comprises rail feelers mounted on a car ahead of the working area to sense the position of the former track and servo means responsive to said feelers to steer said truck or trucks.

3. A railroad track relaying train according to claim 1, in which said steering means comprises feelers mounted on said caterpillar truck or trucks to sense the parallel adjacent track and servo means responsive to said feelers to steer said truck or trucks.

4. A railroad track relaying train according to claim 1, in which said steering means comprises angle measuring devices to measure the angles between the longitudinal axes of a car ahead of the first working car and of said first working car and between the longitudinal axes between each working car and the respective adjacent coupling frame, and servo means responsive to said angle measuring devices to steer said truck or trucks.

5. A railroad track relaying train according to claim 1, comprising a first coupling frame between said car for removing old rails and ties or track panels and said car for excavating ballast and connected by universal joints with adjacent ends of said cars, and a second coupling frame between said car for excavating ballast and said relaying car and connected by universal joints with adjacent ends of said cars.

6. A railroad track relaying train according to claim 1, in which each coupling frame is equipped with two steerable caterpillar trucks at both ends.

7. In a train for removing and relaying railroad track, the combination of a plurality of working cars, each carrying working instrumentalities and comprising a track removing car carrying instrumentalities for removing old track, a ballast excavating car carrying instrumentalities for excavating ballast from the roadbed from which said old track has been removed, and a track relaying car carrying instrumentalities for laying new track, each of said working cars having at opposite ends thereof like bogies for running on railroad track, coupling frames disposed between and connecting consecutive working cars, said coupling frames being shorter than said working cars and carrying no working instrumentalities, each of said coupling frames having at opposite ends thereof means for pivotally coupling said frame to preceding and succeeding working cars, at least one power driven track-laying truck for running on trackless roadbed and supporting each of said coupling frames, means for varying the height of each of said coupling frames with respect to the respective track-laying truck supporting it, said height-varying means being operable to raise the respective coupling frame to a height to support adjacent ends of preceding and succeeding working cars with the respective bogies dependent therefrom, and means for steering said track-laying truck to follow the path of the railroad track being relayed.

8. A railroad track relaying train according to claim 7, in which each of said coupling frames is supported by two track-laying trucks disposed at opposite ends of said frame, and in which said steering means comprises controllable hydraulic cylinders acting between said trucks and said frame.

* * * * *